US007461841B2

(12) United States Patent
Tanaka et al.

(10) Patent No.: US 7,461,841 B2
(45) Date of Patent: Dec. 9, 2008

(54) SHEET DISCHARGING APPARATUS AND IMAGE FORMING APPARATUS

(75) Inventors: Yasuki Tanaka, Saitama (JP); Keiji Sanekata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 159 days.

(21) Appl. No.: 11/446,124

(22) Filed: Jun. 5, 2006

(65) Prior Publication Data

US 2007/0018375 A1 Jan. 25, 2007

(30) Foreign Application Priority Data

Jul. 25, 2005 (JP) ..... 2005-215029

(51) Int. Cl.
*B65H 29/52* (2006.01)

(52) U.S. Cl. ..... 271/312; 271/37; 271/109; 271/188; 271/209; 271/237

(58) Field of Classification Search ..... 271/37, 271/109, 188, 209, 237, 312
See application file for complete search history.

(56) References Cited

U.S. PATENT DOCUMENTS

| | | | | | |
|---|---|---|---|---|---|
| 197,477 | A * | 11/1877 | Kneeland | 271/188 |
| 2,857,161 | A * | 10/1958 | Kist | 271/237 |
| 4,059,203 | A * | 11/1977 | Wright | 221/73 |
| 4,145,041 | A * | 3/1979 | Kew | 271/233 |
| 4,350,332 | A * | 9/1982 | Knight | 271/188 |
| 4,767,114 | A * | 8/1988 | Nishimoto | 271/3.2 |
| 5,060,927 | A * | 10/1991 | Sugiura | 271/117 |
| 5,429,574 | A * | 7/1995 | Murakami | 492/39 |
| 5,553,842 | A * | 9/1996 | Wilcox et al. | 271/109 |
| 5,564,688 | A * | 10/1996 | Samii | 271/109 |
| 5,874,979 | A * | 2/1999 | Ohyama | 347/104 |
| 5,951,005 | A * | 9/1999 | Bartman et al. | 271/188 |
| 6,227,533 | B1 * | 5/2001 | Jang | 271/109 |
| 6,505,833 | B2 * | 1/2003 | Kato et al. | 271/272 |
| 6,896,432 | B2 * | 5/2005 | Ohyama | 400/642 |
| 7,213,986 | B2 | 5/2007 | Watanabe et al. | |
| 2002/0135124 | A1 * | 9/2002 | Suzuki et al. | 271/303 |

(Continued)

FOREIGN PATENT DOCUMENTS

JP 64-008179 A 1/1989

(Continued)

*Primary Examiner*—Patrick Mackey
*Assistant Examiner*—Howard Sanders
(74) *Attorney, Agent, or Firm*—Sughrue Mion, PLLC

(57) ABSTRACT

Disclosed is a sheet discharging apparatus in which an apparatus main body portion is provided with plural discharging rollers for discharging sheets by rotation, and a shaft coaxially fixed to the discharging rollers. The shaft has an outer diameter smaller than an outer diameter of the discharging roller. At the discharging roller side of the shaft is provided a small-diameter portion, with the outer diameter of the small-diameter portion smaller than the outer diameter of another portion. A projection projects from a portion of the apparatus main body portion, a tip end of the projection being disposed in a step between the small-diameter portion and the other portion of the shaft. Also disclosed is an image forming apparatus having the sheet discharging apparatus, in which an image is formed on a sheet, and the sheet on which the image is formed is discharged by the sheet discharging apparatus.

22 Claims, 6 Drawing Sheets

U.S. PATENT DOCUMENTS

| | | | | |
|---|---|---|---|---|
| 2003/0218293 | A1* | 11/2003 | Mizuno et al. | 271/109 |
| 2005/0189698 | A1* | 9/2005 | Somemiya | 271/109 |

FOREIGN PATENT DOCUMENTS

| | | | | |
|---|---|---|---|---|
| JP | 2000-351512 | A | | 12/2000 |
| JP | 2002-128389 | A | | 5/2002 |
| JP | 2002241028 | A | * | 8/2002 |
| JP | 2002370860 | A | * | 12/2002 |
| JP | 2003054807 | A | * | 2/2003 |
| JP | 2003246526 | A | * | 9/2003 |
| JP | 2004025509 | A | * | 1/2004 |
| JP | 2005096951 | A | * | 4/2005 |
| KR | 2000-18668 | A | | 10/2000 |
| KR | 2005-40686 | A | | 5/2005 |

* cited by examiner

SHEET DISCHARGING APPARATUS AND IMAGE FORMING APPARATUS

CROSS-REFERENCE TO RELATED APPLICATION

This application claims priority under 35 USC 119 from Japanese Patent Application No. 2005-215029, the disclosure of which is incorporated by reference herein.

BACKGROUND OF THE INVENTION

1. Field of the Invention

The present invention relates to a sheet discharging apparatus for discharging sheets by a discharging roller, and an image forming apparatus.

2. Description of the Related Art

In a sheet discharging apparatus, in order to prevent a sheet from being entangled after it is discharged by a sheet discharging roller, an entangling-preventing tool is disposed in some cases (e.g., see Japanese Patent No. 2613470). In such an apparatus, a portion of the entangling-preventing tool is loosely fitted on a support shaft of a sheet discharging roller such that a portion of a gap, into which the sheet can be entangled, is closed off.

In such a conventional sheet discharging apparatus, since a separate entangling-preventing tool is required, the number of parts is increased.

SUMMARY OF THE INVENTION

In view of the above circumstances, the present invention provides a sheet discharging apparatus, and an image forming apparatus including the sheet discharging apparatus, that prevent a sheet discharged by a discharging roller from being entangled without increasing the number of parts.

One aspect of the invention provides a sheet discharging apparatus including: an apparatus main body portion; a discharging roller provided on the apparatus main body portion for discharging sheets through rotation thereof; a shaft which is coaxially fixed to a plurality of the discharging rollers, which has an outer diameter smaller than an outer diameter of the discharging rollers and includes a small-diameter portion on the discharging roller side, wherein the small-diameter portion of the shaft has an outer diameter smaller than an outer diameter of another portion of the shaft; and a projection which projects from a portion of the apparatus main body portion, a tip end of the projection being disposed in a step between the small-diameter portion and the other portion of the shaft.

Another aspect of the invention provides an image forming apparatus including: an apparatus main body portion; a discharging roller provided on the apparatus main body portion for discharging sheets through rotation thereof; a shaft which is coaxially fixed to a plurality of the discharging rollers, which has an outer diameter smaller than an outer diameter of the discharging rollers and includes a small-diameter portion on the discharging roller side, wherein the small-diameter portion of the shaft has an outer diameter smaller than an outer diameter of another portion of the shaft; and a projection which projects from a portion of the apparatus main body portion, a tip end of the projection being disposed in a step between the small-diameter portion and the other portion of the shaft, wherein an image is formed on a sheet and the sheet on which the image is formed is discharged by the sheet discharging apparatus.

Other aspects, features and advantages of the present invention will become apparent from the following description taken in conjunction with the accompanying drawings.

BRIEF DESCRIPTION OF THE DRAWNGS

Preferred embodiments of the present invention will be described in detail based on the following figures, in which.

DETAILED DESCRIPTION OF THE INVENTION

A first embodiment of an image forming apparatus in which a sheet discharging apparatus of the present invention is mounted will be explained based on the drawings. The sheet discharging apparatus of this embodiment has a fixing unit.

FIRST EMBODIMENT

Figure 1:
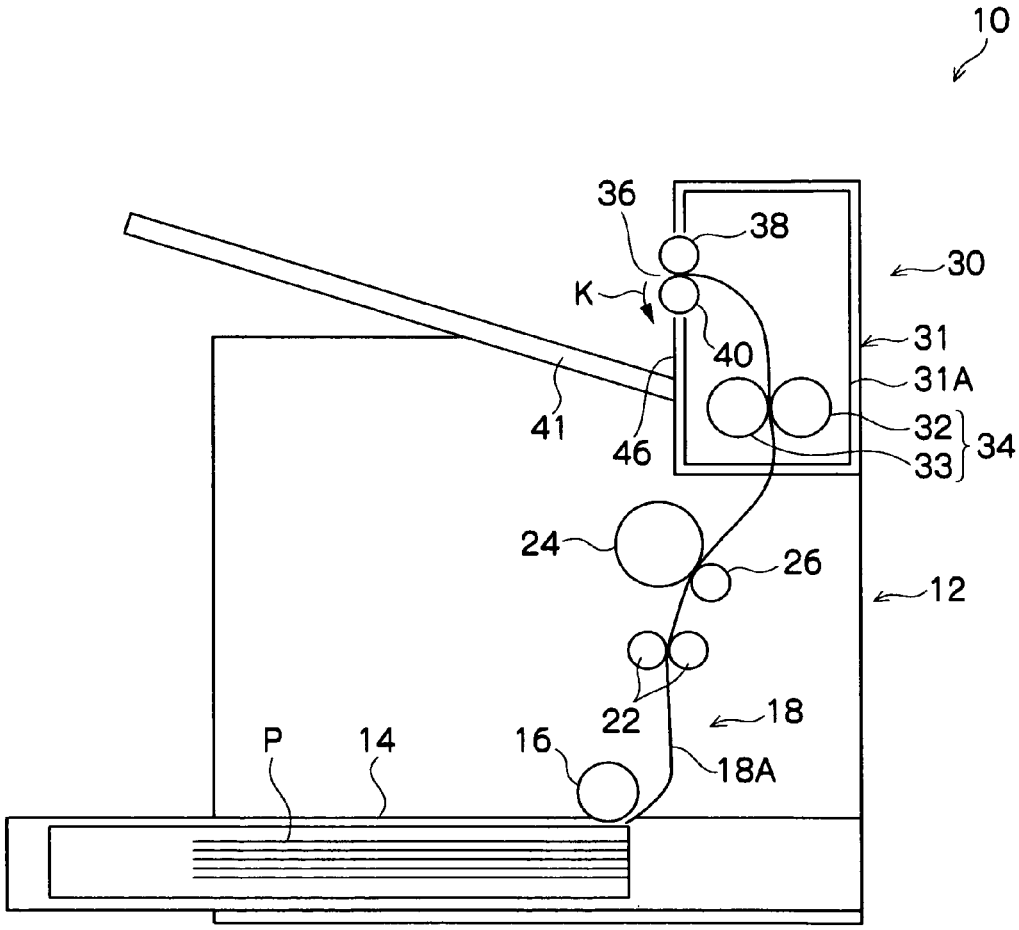
FIG. 1 is a schematic block diagram showing an image forming apparatus in which a sheet discharging apparatus according to a first embodiment of the invention is mounted.

In the image forming apparatus 10 illustrated in FIG. 1, a toner image is formed on a recording sheet P, and the recording sheet P on which the toner image is formed is discharged by means of a sheet discharging apparatus 30. The image forming apparatus 10 includes an apparatus main body 12 which is provided at its lower portion with a detachable paper feed cassette 14. Plural of recording sheets P are accommodated in the paper feed cassette 14. A paper feed roller 16 is disposed above the paper feed cassette 14, and if the paper feed roller 16 rotates, the recording sheets P are supplied upward one sheet at a time.

The paper feed roller 16 is provided with a conveying mechanism 18 on a sheet discharging side. The conveying mechanism 18 includes parts (such as a guide plate and a convey roller 22) for defining a conveying path 1 8A which extends substantially vertically. These parts convey the recording sheets P toward a discharging side. Here, the conveying path 18A is a recording sheet pathway. The convey roller 22 disposed in the conveying mechanism 18 conveys the recording sheets P along the conveying path 18A.

A photosensitive drum 24 is disposed at an intermediate portion of the conveying mechanism 18. Charging processing, exposing processing and developing processing are carried out on the photosensitive drum 24, and a toner image is formed on the photosensitive drum 24. A transfer roller 26 is disposed at a location opposing the photosensitive drum 24. The transfer roller 26 transfers a toner image on the photosensitive drum 24 to the recording sheet P.

A sheet discharging apparatus 30 mounted on the apparatus main body 12 is disposed downstream, in the transferring direction, of the photosensitive drum 24 and the transfer roller 26 (top of FIG. 1). An apparatus main body portion 31 of the sheet discharging apparatus 30 includes a fixing unit 34. The fixing unit 34 comprises a pressure roller 32 and a heating roller 33. The fixing unit 34 thermally fixes an image on a recording sheet P on which a toner image is transferred by the transfer roller 26 while nipping and conveying the recording sheet P.

In the apparatus main body portion 31 of the sheet discharging apparatus 30, a sheet discharging opening 36 is formed on the downstream side in the transfer direction of the fixing unit 34, a sheet discharging idling roller 38 and a sheet discharging driving roller 40 as a discharging roller are vertically opposed to each other. In this embodiment, the sheet discharging driving roller 40 is disposed below the sheet discharging idling roller 38.

The sheet discharging driving roller 40 and the sheet discharging idling roller 38 are made of rubber having a high coefficient of friction. When recording sheets P are to be discharged, the sheet discharging driving roller 40 and the sheet discharging idling roller 38 nip and convey the recording sheets P, by rotation, to discharge the recording sheets P from the sheet discharging opening 36. A catch tray 41 is mounted on the apparatus main body portion 31 below the sheet discharging opening 36 so that recording sheets P discharged by the sheet discharging driving roller 40 and the sheet discharging idling roller 38 are accumulated on the catch tray 41.

Figure 2:
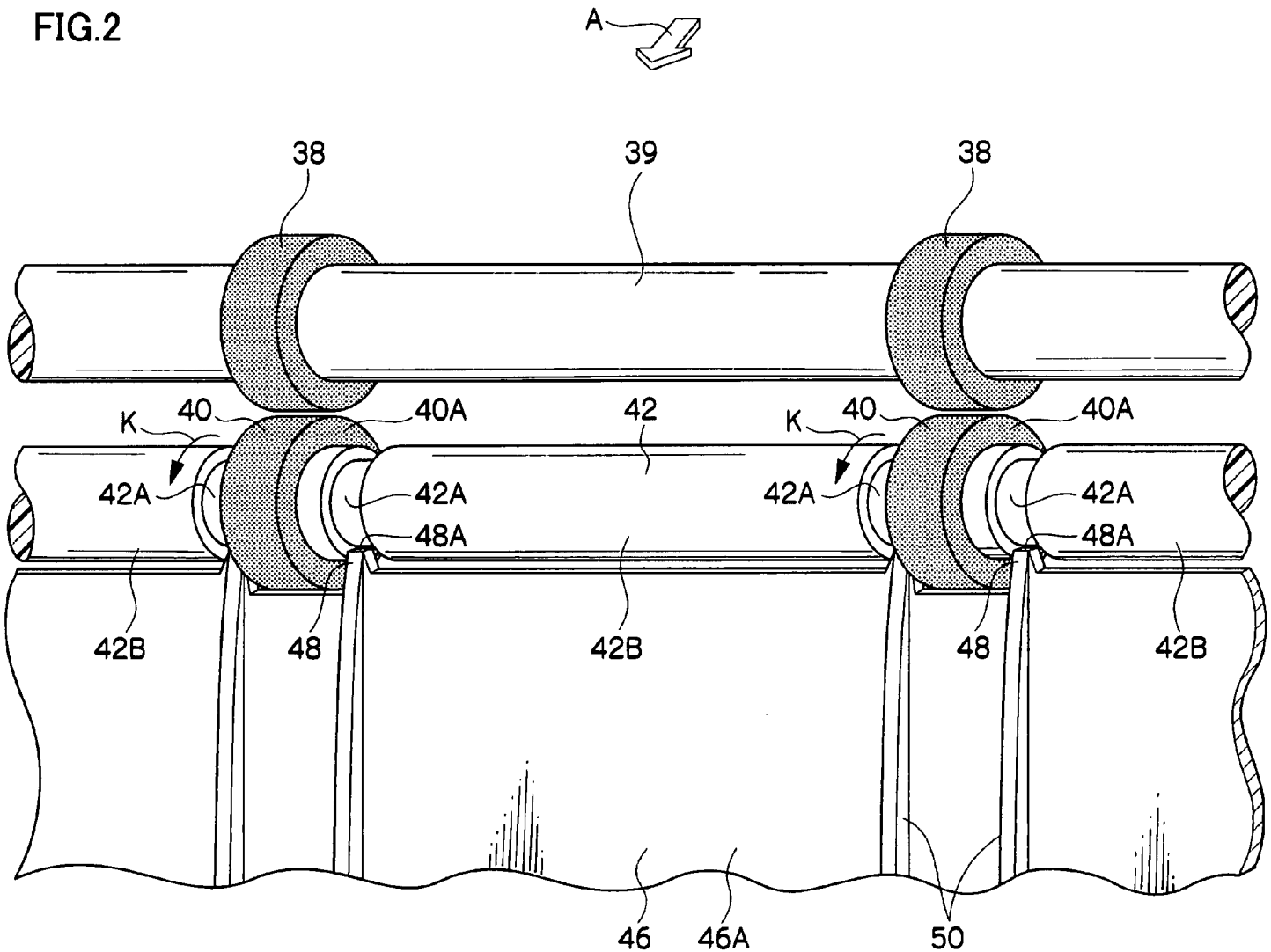
FIG. 2 is a perspective view of a discharging portion of the sheet discharging apparatus according to the first embodiment of the invention.

As shown in FIG. 2, a cylindrical idling roller shaft 39 is coaxially fixed to plural sheet discharging idling rollers 38. The idling roller shaft 39 is made of resin, and is rotatably supported by an apparatus frame 31A of the apparatus main body portion 31 shown in FIG. 1.

As shown in FIG. 2, a cylindrical drive roller shaft 42 as a shaft is coaxially fixed to plural sheet discharging driving rollers 40. The drive roller shaft 42 is, like the idling roller shaft 39, made of resin and is rotatably supported by the apparatus frame 31A of the apparatus main body portion 31 shown in FIG. 1.

By making the idling roller shaft 39 and the drive roller shaft 42 shown in FIG. 2 of resin, it is easy to prevent the rubber sheet discharging idling roller 38 and the sheet discharging driving roller 40 dropping out, and it is possible to reduce costs.

The material of the idling roller is not limited to rubber having a high coefficient of friction as exemplified, and the roller may be made of resin. The idling rollers need not be fixed in plural to the shafts 39 coaxially, and the idling rollers may configured to be independent from each other.

A gear mechanism (not shown) is connected to the drive roller shaft 42. The sheet discharging apparatus 30 shown in FIG. 1 is mounted on the apparatus main body 12 of the image forming apparatus 10. With this, a gear (not shown) of the gear mechanism is meshed with the gear (not shown) of the gear mechanism provided on the apparatus main body 12. The gear of the gear mechanism provided on the apparatus main body 12 is rotated and driven in accordance with instructions from a controller (not shown) of the apparatus main body 12.

With this, in a state in which the sheet discharging apparatus 30 is mounted on the apparatus main body 12, the drive roller shaft 42 and the sheet discharging driving roller 40 shown in FIG. 2 are rotated through the gear mechanism (not shown) in accordance with the instructions from the controller (not shown) of the apparatus main body 12.

An outer diameter of the drive roller shaft 42 is smaller than an outer diameter of the sheet discharging driving roller 40. The drive roller shaft 42 is formed with a small-diameter portion 42A on the sheet discharging driving roller 40 side (closer to a side surface 40A). An outer diameter of the small-diameter portion 42A is smaller than an outer diameter of a large-diameter portion 42B which is another portion of the drive roller shaft 42.

The small-diameter portion 42A is formed only on the sheet discharging driving roller 40 side. Therefore, influence on strength and deflection of the drive roller shaft 42 is extremely small.

A tip end 48A of a projection 48 is disposed projecting from an apparatus cover 46 as a partition wall in a step (groove) between the small-diameter portion 42A and the large-diameter portion 42B. With this, a portion of a gap into which the recording sheet P is entangled is closed off.

The apparatus cover 46 is provided on the apparatus main body portion 31 (see FIG. 1) and disposed below the drive roller shaft 42. The apparatus cover 46 separates an inside and an outside of the apparatus main body portion 31, and aligns the trailing edges of discharged recording sheets P. A cover outer surface 46A of the apparatus cover 46 is formed with a rib 50 on the sheet discharging direction (direction of arrow A) side (outside). The rib 50 extends disposed in the vertical direction, and the rib 50 reduces a resistance between a trailing edge back plate BP (see FIG. 3) of the discharged recording sheet P and the apparatus cover 46, and makes the accommodating performance excellent. An upper portion of the rib 50 forms the projection 48.

When the projection 48 is formed on the apparatus cover 46, there is an advantage that materials and shapes can be selected with few constraints. In order to allow the discharged recording sheets P to drop easily and make full use of this advantage, it is preferable that the coefficient of friction of the projection 48 be set low. To prevent possible injury to a user, the tip end 48A of the projection 48 is preferably not sharp.

Figure 3:
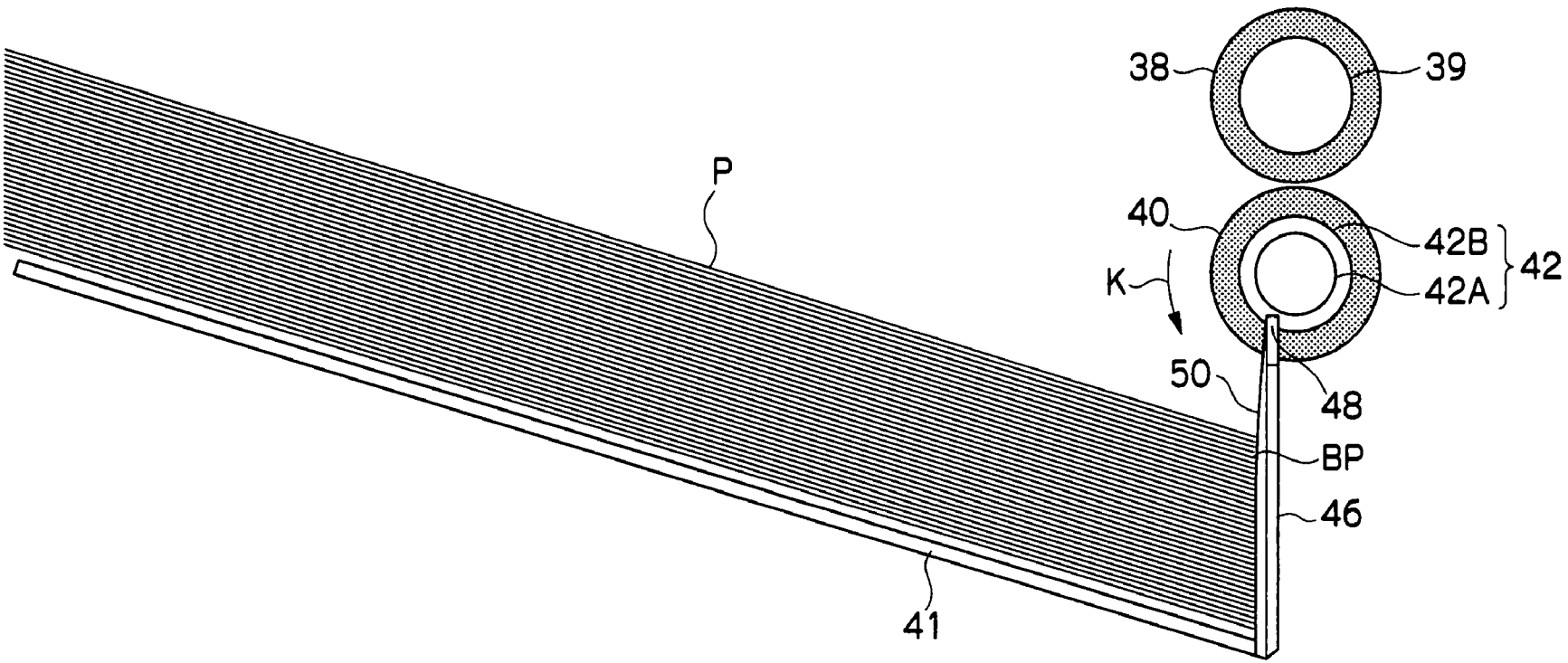
FIG. 3 is a side block diagram showing the discharging portion of the sheet discharging apparatus according to the first embodiment of the invention as viewed from an axial direction of a drive roller shaft.
Figure 4:
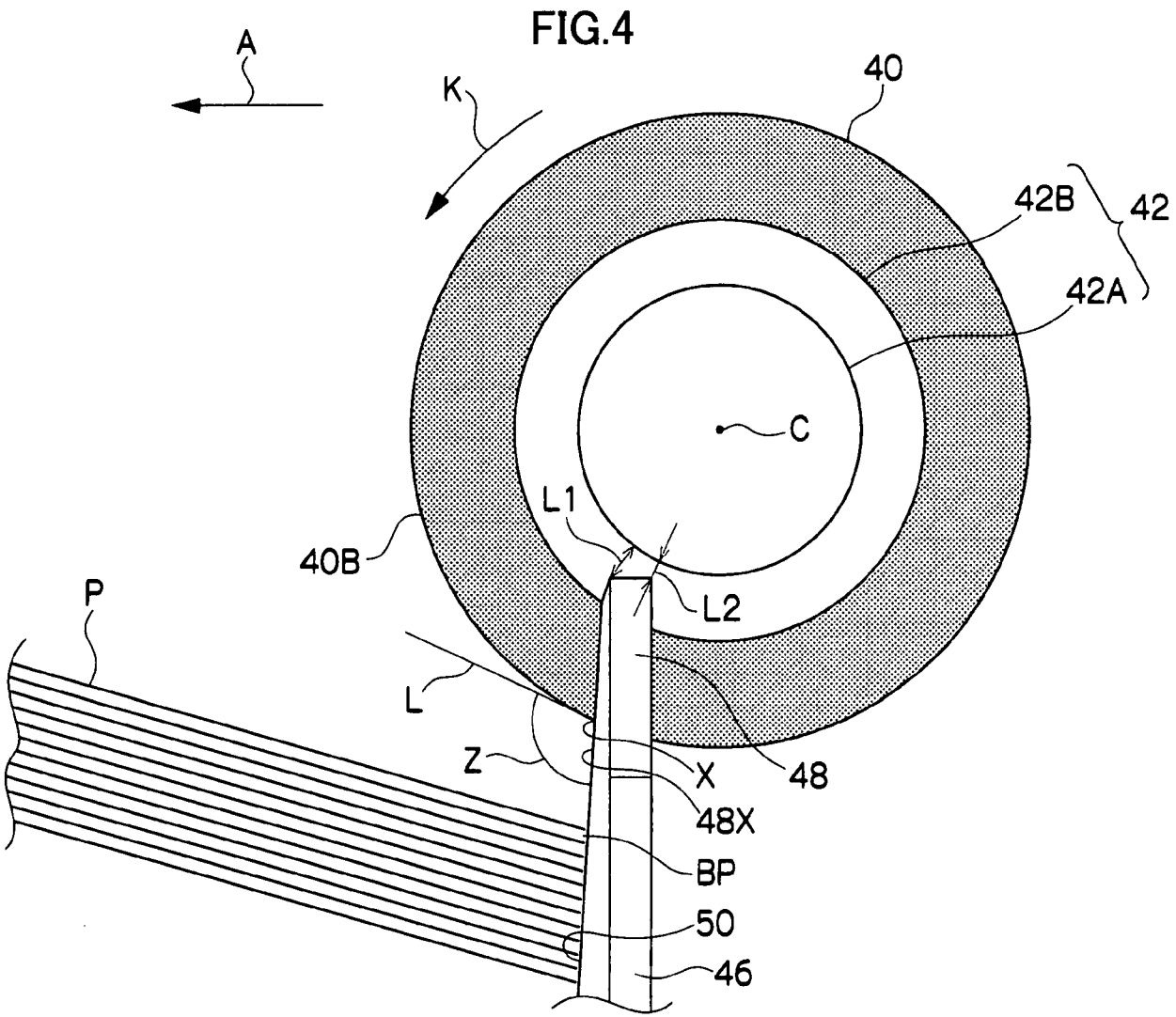
FIG. 4 is a side block diagram of a main portion of the sheet discharging apparatus according to the first embodiment of the invention as viewed from the axial direction of the drive roller shaft.

FIGS. 3 and 4 are side views of the drive roller shaft 42 as viewed from the axial direction thereof. As shown in FIG. 4, an intersection X between a side portion in the sheet discharging direction (direction of arrow A) on the projection 48 ("side portion 48X in the discharging direction", hereinafter) and an outer peripheral surface 40B of the sheet discharging driving roller 40 is set lower than an axis C of the drive roller shaft 42. An angle Z formed between the side portion 48X in the discharging direction on the projection 48 and a tangent L in the intersection X of the outer peripheral surface 40B of the sheet discharging driving roller 40 is set to an obtuse angle. With this, a trailing edge BP of the recording sheet P after it is discharged comes into contact with the sheet discharging driving roller 40, and even when the trailing edge BP receives a rotation force from the sheet discharging driving roller 40 (force in the direction of arrow K), since the resultant of forces in the dropping direction is great, the trailing edge BP abuts against the projection 48 and then the trailing edge BP easily drops downward as it is.

The shortest distance L1 between the side portion 48X in the discharging direction on the projection 48 and the small-diameter portion 42A is set longer than the shortest distance L2 between the projection 48 and the small-diameter portion 42A. By doing this, even if the projection 48 interferes with the drive roller shaft 42 due to deflection of the drive roller shaft 42, the portion of the projection 48 where the distance from the small-diameter portion 42A is closest interferes first, earlier than the side portion 48X in the discharging direction on the projection 48, it is possible to prevent the side portion 48X in the discharging direction in the projection 48 from being damaged by wearing or the like. Thus, even in such a case also, it is possible to suppress the generation of a gap into which a recording sheet P is entangled.

A shape of the projection 48 having the above-described structure is less prone restriction in the mold-releasing direction, and there is an advantage that the mold can be simplified and thus, costs can be reduced.

In this embodiment, an outer diameter of the sheet discharging driving roller 40 is designed after taking deflection of 0.5 mm and position tolerance of 0.1 mm into consideration. The projection 48 is disposed inside of a circle located inside by a further 0.5 mm from an outer diameter of the sheet discharging driving roller 40 after taking the position tolerance (0.1 mm) into consideration. The outer diameter of the drive roller shaft 42 is designed while taking the deflection of 0.5 mm and the position tolerance of 0.1 mm into consideration, and the projection 48 is designed while taking the size tolerance of 0.3 mm into consideration.

Next, the operation of the first embodiment will be explained.

As shown in FIG. 1, recording sheets P loaded in the paper feed cassette 14 are supplied to the conveying mechanism 18 by the paper feed roller 16. In the conveying mechanism 18, the convey roller 22 transfers the recording sheets P along the conveying path 18A, and the transfer roller 26 transfers the toner image on the photosensitive drum 24 onto the recording sheets P. Next, the fixing unit 34 thermally fixes the toner image on the recording sheet P, the sheet discharging driving roller 40 and the sheet discharging idling roller 38 discharge the recording sheets P to the catch tray 41.

Even if the trailing edge BP (see FIG. 4) of the recording sheet P after it is discharged comes into contact with the sheet discharging driving roller 40 shown in FIG. 2 and the recording sheet P receives the rotation force (force in the direction of arrow K) from the sheet discharging driving roller 40, it abuts against the projection 48 and drops into the lower catch tray 41 (see FIG. 3) and thus, the recording sheet P is prevented from being entangled by the sheet discharging driving roller 40.

In addition, even if the drive roller shaft 42 and the sheet discharging driving roller 40 are slightly deflected by the rotation, since the projection 48 is disposed in the step (groove) between the small-diameter portion 42A and the large-diameter portion 42B in the drive roller shaft 42, it is possible to suppress the generation of a gap into which the recording sheet P is entangled.

As explained above, it is unnecessary to separately provide an entangling-preventing member, and it is possible to prevent the recording sheet P from being entangled by the drive roller shaft 42 without-increasing the number of parts, and the costs can also be reduced.

Since the tip end 48A of the projection 48 is disposed in the step (groove) between the small-diameter portion 42A and the large-diameter portion 42B, it is possible to widen the gap between the projection 48 and the drive roller shaft 42, and it is possible to employ a structure in which the projection 48 and the drive roller shaft 42 hardly interfere with each other even if a tolerance or the like is generated due to deflection or mounting of the drive roller shaft 42.

SECOND EMBODIMENT

A second embodiment of the image forming apparatus in which a sheet discharging apparatus is mounted will be explained based on FIGS. 5A and 5B. The same constituent portions as those of the first embodiment are designated with the same symbols, and explanation thereof will be omitted.

Figure 5A:
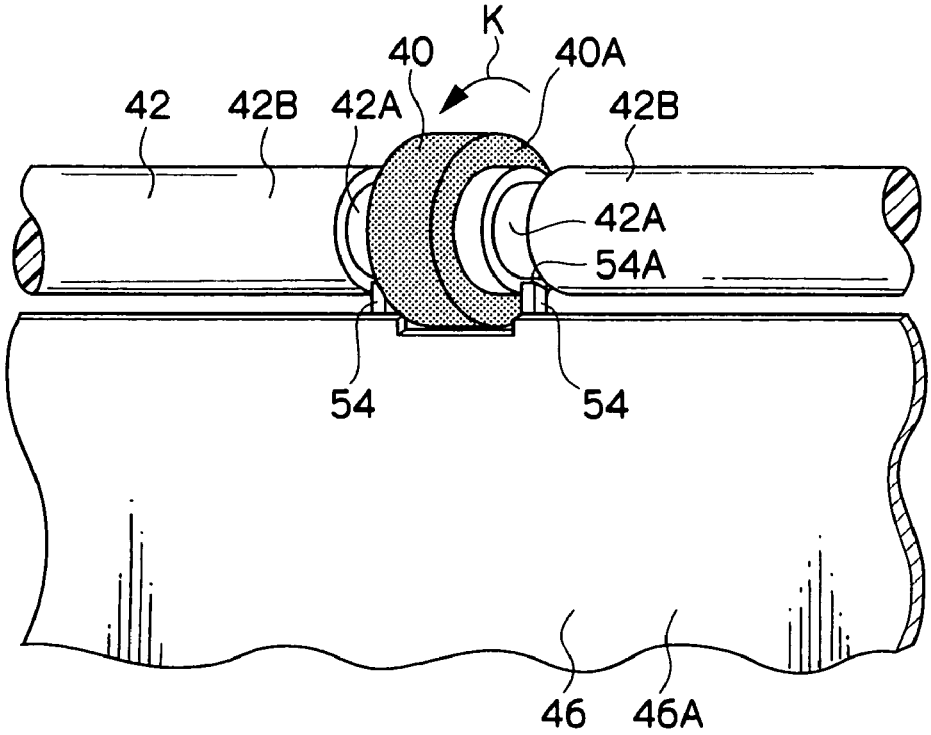
FIG. 5A is a perspective view of a discharging portion of a sheet discharging apparatus according to a second embodiment of the invention.
Figure 5B:
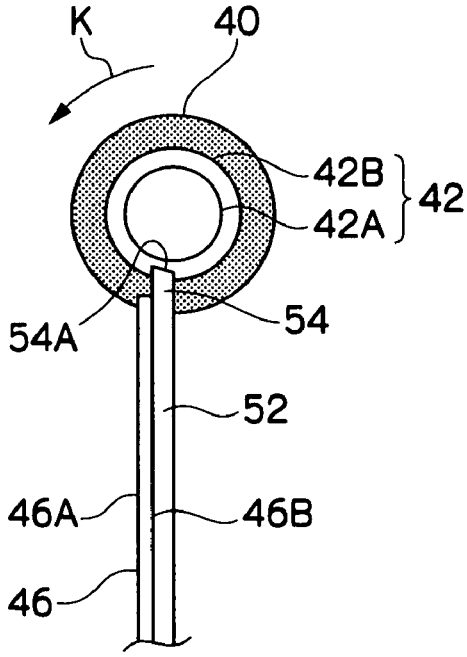
FIG. 5B is a side block diagram of a portion of the discharging portion of the sheet discharging apparatus according to the second embodiment of the invention as viewed from an axial direction of a drive roller shaft.

As shown in FIGS. 5A and 5B, the apparatus cover 46 is formed with a rib 52. The rib 52 is located on a cover inner surface 46B which is on the opposite side from the cover outer surface 46A. The rib 52 extends disposed in the vertical direction. An upper portion of the rib 52 forms a projection 54. A tip end 54A of the projection 54 projecting from the apparatus cover 46 is disposed in a step (groove) between the small-diameter portion 42A and the large-diameter portion 42B. With this, a portion of a gap into which a recording sheet P is entangled is closed off.

According to this embodiment, most of the portion of the rib 52 forming the projection 54 can not be seen from a front side due to the apparatus cover 46. Therefore, it is possible to prevent the recording sheet P from entangling due to the sheet discharging driving roller 40 without affecting the design of the cover outer surface 46A.

THIRD EMBODIMENT

Figure 6A:
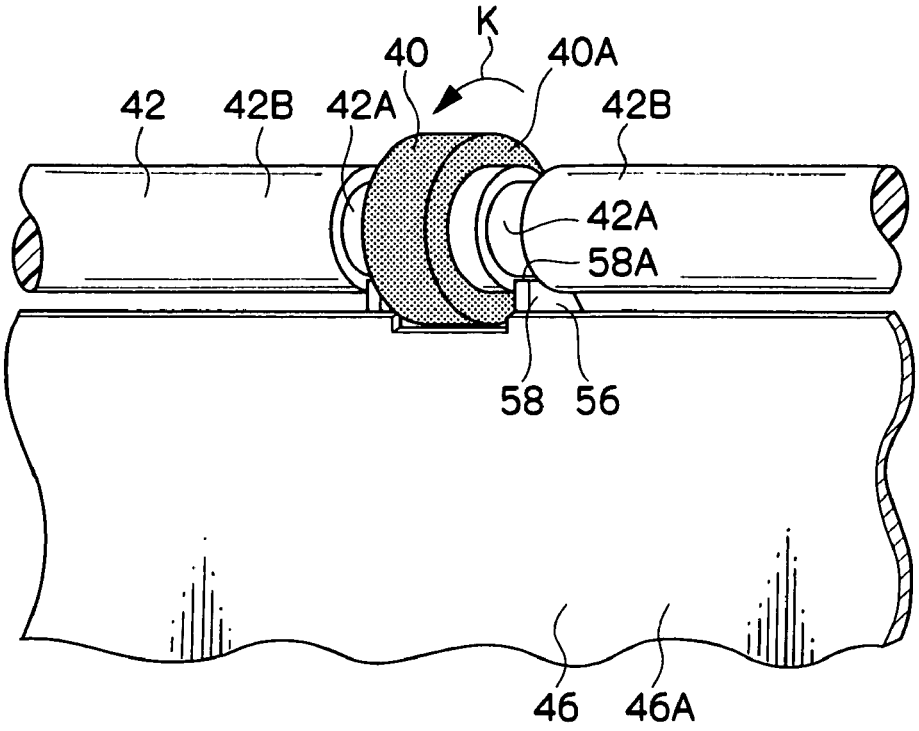
FIG. 6A is a perspective view showing a portion of a discharging portion of a sheet discharging apparatus according to a third embodiment of the invention.
Figure 6B:
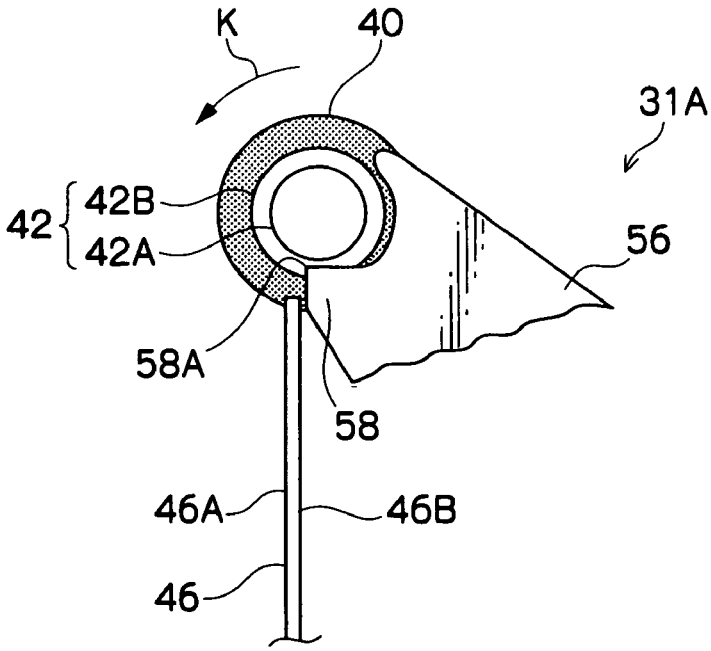
FIG. 6B is a side block diagram of a portion of the discharging portion of the sheet discharging apparatus according to the third embodiment of the invention as viewed from an axial direction of a drive roller shaft.

Next, a third embodiment of the image forming apparatus in which a sheet discharging apparatus is mounted will be explained based on FIGS. 6A and 6B. The same constituent portions as those of the first and second embodiments are designated with the same symbols, and explanation thereof will be omitted.

As explained in the first embodiment, the drive roller shaft 42 is rotatably supported by an apparatus frame 31A of an apparatus main body portion 31 shown in FIG. 1. In FIGS. 6A and 6B, a fixing unit rib 56 on the apparatus frame 31A is shown on the side of the cover inner surface 46B of the apparatus cover 46.

A tip end of the fixing unit rib 56 is bifurcated and curved, and a lower curved portion forms a projection 58. A tip end 58A of the projection 58 projecting from the fixing unit rib 56 is disposed in a step (groove) between the small-diameter portion 42A and the large-diameter portion 42B, and a portion of a gap into which the recording sheet P can be entangled is closed off.

A portion of the apparatus frame 31 A which supports the drive roller shaft 42 is formed with the projection 58. With this, a relative positional precision between the drive roller shaft 42 and the projection 58 can be made excellent. Like the second embodiment, design of the cover outer surface 46A is not affected.

Although the sheet discharging apparatus 30 is a portion of a standard mechanism of the image forming apparatus 10 in the above-described embodiments as shown in FIG. 1, the sheet discharging apparatus 30 may be an optional device such as Hi-Capacity-Stacker and Stapler which is separate from an image forming apparatus 10 of standard structure.

Although the sheet discharging apparatus 30 includes the fixing unit 34 in the above-described embodiments, the sheet discharging apparatus need not include the fixing unit.

What is claimed is:

1. A sheet discharging apparatus comprising:

a sheet discharging apparatus main body portion;

a plurality of discharging rollers, attached to the apparatus main body portion, which discharge sheets, onto a catch tray, through a rotation thereof;

a shaft which is coaxially fixed to the plurality of the discharging rollers, wherein the shaft has first diameter portions and at least one second diameter portion disposed adjacent to a discharging roller, wherein the first diameter portions have a first diameter smaller than a diameter of the plurality of discharging rollers, and the at least one second diameter portion has a second diameter smaller than the first diameter; and a projection, which projects from the apparatus main body portion, comprising a tip end disposed in a groove formed by the at least one second diameter portion;

wherein the shaft rotates in a direction such that, at a side adjacent to the catch tray, the shaft rotates downward toward an upper surface of the catch tray.

2. The sheet discharging apparatus according to claim 1, wherein:

the projection is disposed below an axis of the shaft; and, the projection extends in a direction which forms an obtuse angle with tangent of an outer peripheral surface of the discharging roller.

3. The sheet discharging apparatus according to claim 1, wherein the tip end of the projection has a first edge and a second edge, opposite the first edge, and the first edge is closer, in a radial direction, than the second edge to a circumferential surface of the at least one second diameter portion.

4. The sheet discharging apparatus according to claim 2, wherein the tip end of the projection has a first edge and a second edge, opposite the first edge, and the first edge is closer, in a radial direction, than the second edge to a circumferential surface of the at least one second diameter portion.

5. The sheet discharging apparatus according to claim 1, wherein the projection is a first projection and the apparatus further comprises a second projection, wherein the first and second projections form partition walls operable to position a trailing edge of a discharged sheet within the catch tray.

6. The sheet discharging apparatus according to claim 2, wherein the projection is a first projection and the apparatus further comprises a second projection, wherein the first and second projections form partition walls operable to position a trailing edge of a discharged sheet within the catch tray.

7. The sheet discharging apparatus according to claim 3, wherein the projection is a first projection and the apparatus further comprises a second projection, wherein the first and second projections form partition walls operable to position a trailing edge of a discharged sheet within the catch tray.

8. The sheet discharging apparatus according to claim 4, wherein the projection is a first projection and the apparatus further comprises a second projection, wherein the first and second projections form partition walls operable to position a trailing edge of a discharged sheet within the catch tray.

9. The sheet discharging apparatus according to claim 5, further comprising an apparatus cover extending from the apparatus main body portion, wherein the partition walls comprise ribs on the apparatus cover.

10. The sheet discharging apparatus according to claim 6, further comprising an apparatus cover extending from the apparatus main body portion, wherein the partition walls comprise ribs on the apparatus cover.

11. The sheet discharging apparatus according to claim 7, further comprising an apparatus cover extending from the apparatus main body portion, wherein the partition walls comprise ribs on the apparams cover.

12. The sheet discharging apparatus according to claim 8, further comprising an apparatus cover extending from the apparatus main body portion, wherein the partition walls comprise ribs on the apparatus cover.

13. The sheet discharging apparatus according to claim 1, further comprising an apparatus frame, which is provided on the apparatus main body portion and which supports the shaft, wherein the projection is formed on the apparatus frame.

14. The sheet discharging apparatus according to claim 2, further comprising an apparatus frame, which is provided on the apparatus main body portion and which supports the shaft, wherein the projection is formed on the apparatus frame.

15. The sheet discharging apparatus according to claim 3, further comprising an apparatus frame, which is provided on the apparatus main body portion and which supports the shaft, wherein the projection is formed on the apparatus frame.

16. The sheet discharging apparatus according to claim 4, further comprising an apparatus frame, which is provided on the apparatus main body portion and which supports the shaft, wherein the projection is formed on the apparatus frame.

17. An image forming apparatus comprising the sheet discharging apparatus according to claim 1, wherein the sheet discharging apparatus discharges sheets comprising images formed by the image forming apparatus.

18. An image forming apparatus comprising the sheet discharging apparatus according to claim 2, wherein the sheet discharging apparatus discharges sheets comprising images formed by the image forming apparatus.

19. An image forming apparatus comprising the sheet discharging apparatus according to claim 3, wherein the sheet discharging apparatus discharges sheets comprising images formed by the image forming apparatus.

20. An image forming apparatus comprising the sheet discharging apparatus according to claim 5, wherein the sheet discharging apparatus discharges sheets comprising images formed by the image forming apparatus.

21. An image forming apparatus comprising the sheet discharging apparatus according to claim 9, wherein the sheet discharging apparatus discharges sheets comprising images formed by the image forming apparatus.

22. An image forming apparatus comprising the sheet discharging apparatus according to claim 13, wherein the sheet discharging apparatus disharges sheets comprising images formed by the imaae forming apparatus.

* * * * *